United States Patent [19]

Hussell

[11] Patent Number: 5,076,460

[45] Date of Patent: Dec. 31, 1991

[54] THREE BALL SNAP HINGE BOX

[76] Inventor: Donald E. Hussell, 602 Santee Rd., NE., Roanoke, Va. 24019

[21] Appl. No.: 654,546

[22] Filed: Feb. 13, 1991

[51] Int. Cl.[5] ..... B65D 43/16

[52] U.S. Cl. ..... 220/338; 220/337; 220/324

[58] Field of Search ..... 220/337, 338, 324; 215/237

[56] References Cited

U.S. PATENT DOCUMENTS

| | | | |
|---|---|---|---|
| 2,765,096 | 10/1956 | Sharp | 220/324 |
| 3,061,137 | 10/1962 | Svoboda et al. | 220/338 |
| 3,151,899 | 10/1964 | Kelley | 220/324 X |
| 3,243,838 | 4/1966 | Blumberg | 220/338 X |
| 3,295,713 | 1/1967 | Optner | 220/337 |
| 3,317,620 | 4/1967 | Svoboda et al. | 220/338 |
| 3,328,831 | 7/1967 | Fiore, Jr. | 220/338 X |
| 3,786,982 | 1/1974 | Rakes et al. | 220/324 X |
| 3,866,793 | 2/1975 | Mulligan | 220/338 X |
| 3,994,416 | 11/1976 | Mulligan | 220/338 |

FOREIGN PATENT DOCUMENTS

| | | | |
|---|---|---|---|
| 644554 | 10/1950 | United Kingdom | 220/338 |

*Primary Examiner*—Stephen P. Garbe

*Assistant Examiner*—Vanessa M. Roberts

*Attorney, Agent, or Firm*—Richard C. Litman

[57] ABSTRACT

A molded plastic snap hinge box comprises two halves (U, L) with a hinge (H) formed from parts integrally molded to the two halves. One half of the hinge consists of three balls (20, 24) in a row, all on ball support arms extending from the box. The middle ball is larger than the two side balls; the two side balls are of equal diameter. Two coaxial cylindrical spacers (30) are mounted on spacer support arms extending from the other box half. The cylinder ends are dished spherically with radii equal to the ball radii; the cylinders snap in between the balls to form the hinges. When the hinge is assembled the three balls are each centered on the cylindrical spacers' axis, which runs parallel to the rear edge of the box in the plane of the box opening rim. The box may be closed with a latch closure (C) comprising a plate (40) on either box half. The plates are each coplanar with the opening rim. Each plate has a hole (44) and a post (42), the post of one plate mating with the hole of the other. The posts are inclined from the plane of the plates so that they interfere slightly with the holes when entering. This latches the box. The plates are offset from each other to provide for unlatching by finger forces.

3 Claims, 3 Drawing Sheets

FIG. 3
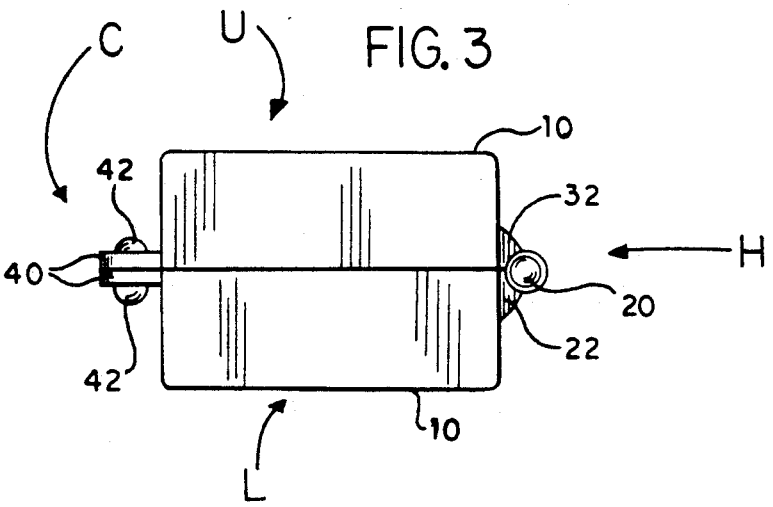
FIG. 4
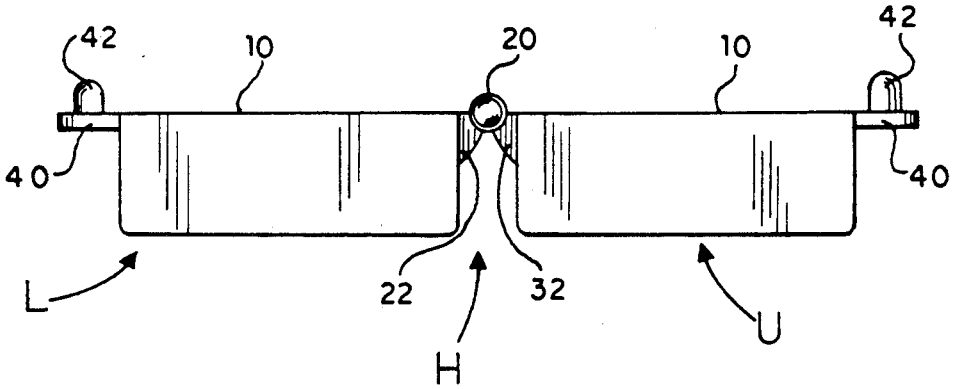
FIG. 5
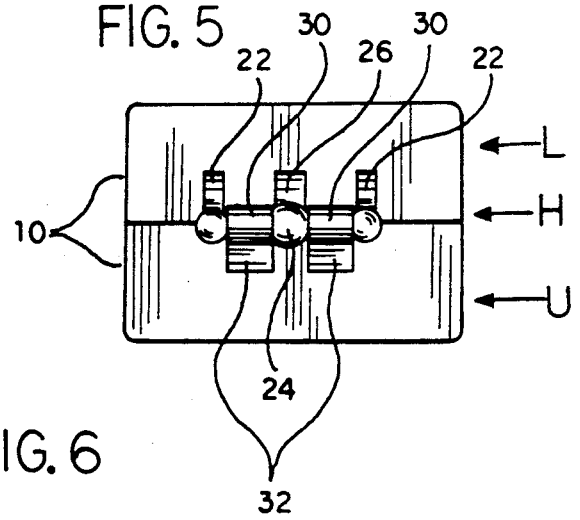
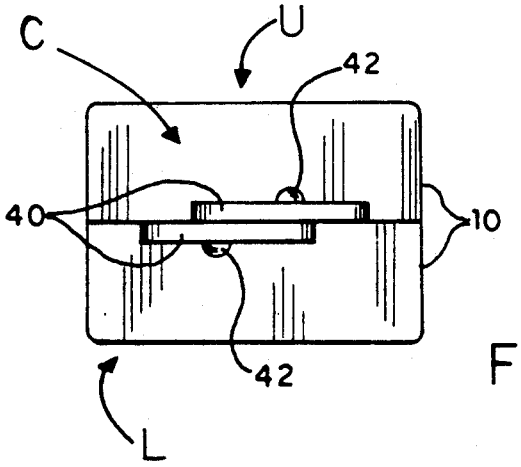
FIG. 6

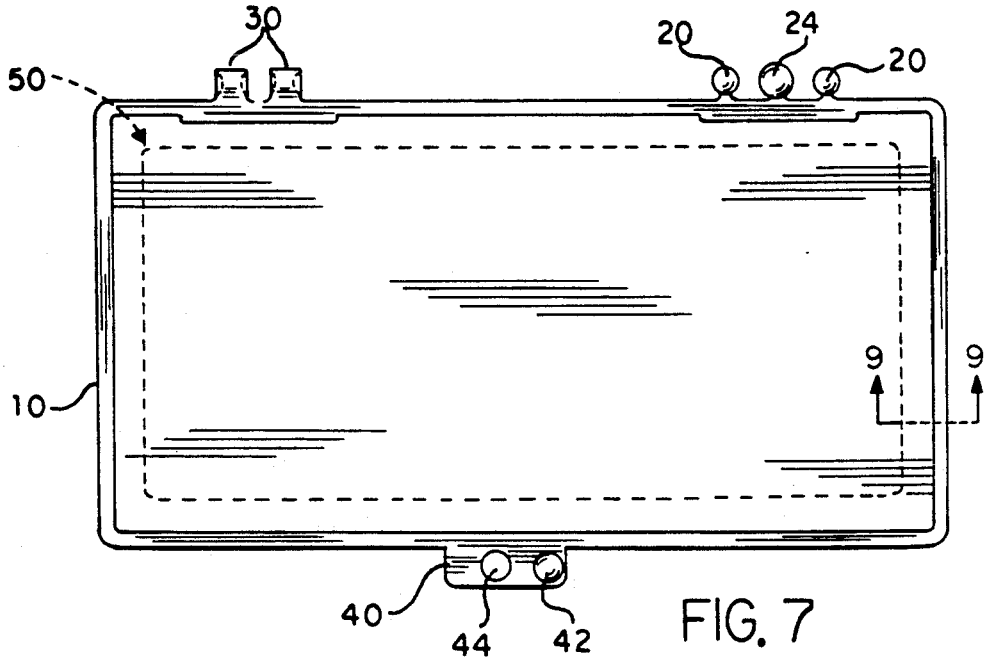
FIG. 7
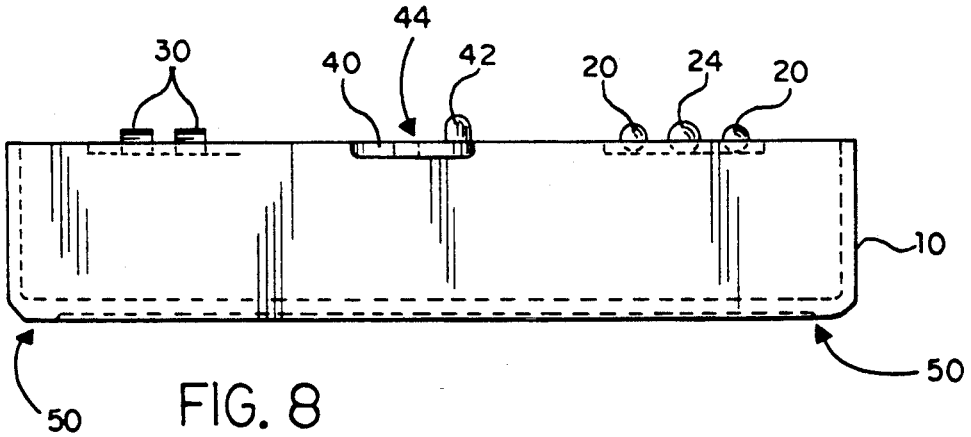
FIG. 8
FIG. 9
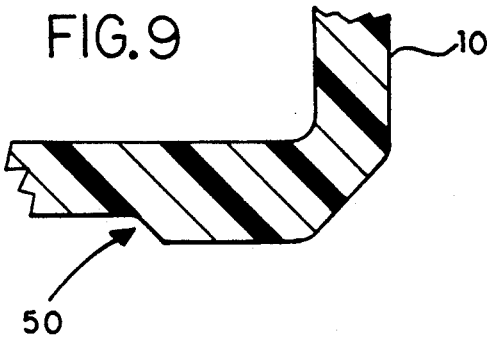

THREE BALL SNAP HINGE BOX

FIELD OF THE INVENTION

The present invention relates to plastic hinges which snap together.

DESCRIPTION OF THE PRIOR ART

Plastic hinges which are molded into an article such as a box are well known.

Egger, in U.S. Pat. No. 3,077,282, shows a plastic box with two-ball hinges molded into the plastic. The two balls are spaced apart along the rear edge of one half of the box. The mating half of the box has a molded cylindrical piece whose axis is offset from and parallel to the rear edge of that half of the box. When the box halves are joined the cylindrical piece fits in between the two balls. The cylinder ends are dished out with spherical depressions which mate with the spherical surfaces of the balls. The balls and mating cylinder form a hinge joint; when the hinge is assembled, the balls fit snugly within the depressions and are prevented from moving. The joint snaps together or apart when force is applied sufficient to elastically bend the balls apart so that they pass over the rims of the depressions.

U.S. Pat. No. 4,109,821 issued to Lutz discloses a molded box with ball and socket joints. Each hinge includes one ball.

Nakanishi, in U.S. Pat. No. 4,658,471, shows a hinge which uses steel balls instead of pins as the joining elements. Each half of the hinge is formed to wrap around a metal or plastic cylindrical core element. The core elements contain spherical depressions at their ends which fit the balls. The balls serve as pivots for the core elements and the hinges.

Mayr, in U.S. Pat. No. 4,253,268, discloses semi-rigid plastic toys elements which snap together with integrally molded balls and integrally molded partial sockets into which the balls snap.

None of the above inventions and patents, taken either singly or in combination, is seen to describe the instant invention as claimed.

The prior art ball snap hinges suffer from lack of holding power. Two balls do not provide sufficient resistance to forces and moments which tend to separate a hinge.

Accordingly, one object of the present invention is a three-ball snap hinge.

Another object is a snap hinge with increased holding power.

These and other objects of the present invention will become readily apparent upon further review of the following specification and drawings.

SUMMARY OF THE INVENTION

The present invention is a molded snap hinge box having two halves. Each half is molded as a unit from any stiff but elastic material such as plastic. The box hinge is formed from parts integrally molded to the two halves. One half of the hinge consists of three balls in a row, all on ball support arms extending from the box. The middle ball is larger than the two side balls; the two side balls are of equal diameter. Two coaxial cylindrical spacers are mounted on spacer support arms extending from the other box half. The cylinder ends are dished spherically with radii equal to the ball radii; the cylinders snap in between the balls to form the hinges. When the hinge is assembled the three balls are each centered on the cylindrical spacers' axis, which runs parallel to the rear edge of the box in the plane of the box opening rim. The box may be closed with a latch comprising a plate on either box half. The plates are each coplanar with the opening rim. Each plate has a hole and a post, the post of one plate mating with the hole of the other. The posts are inclined from the plane of the plates so that they interfere slightly with the holes when entering. This latches the box. The plates are offset from each other to provide for unlatching by finger forces.

BRIEF DESCRIPTION OF THE DRAWINGS

FIG. 3 is a side elevation view of the closed box.

FIG. 4 is a side elevation view of the open box.

FIG. 5 is an end elevation view of the closed box.

FIG. 6 is a view of the box of FIG. 5 from the other side.

FIGS. 7 and 8 are plan and elevation views of an alternate two-hinge embodiment, showing only one half a complete box.

FIG. 9 is a cross section along cut 9—9 of FIG. 7.

Similar reference characters denote corresponding features consistently throughout the attached drawings.

DETAILED DESCRIPTION OF THE PREFERRED EMBODIMENTS

Figure 1:
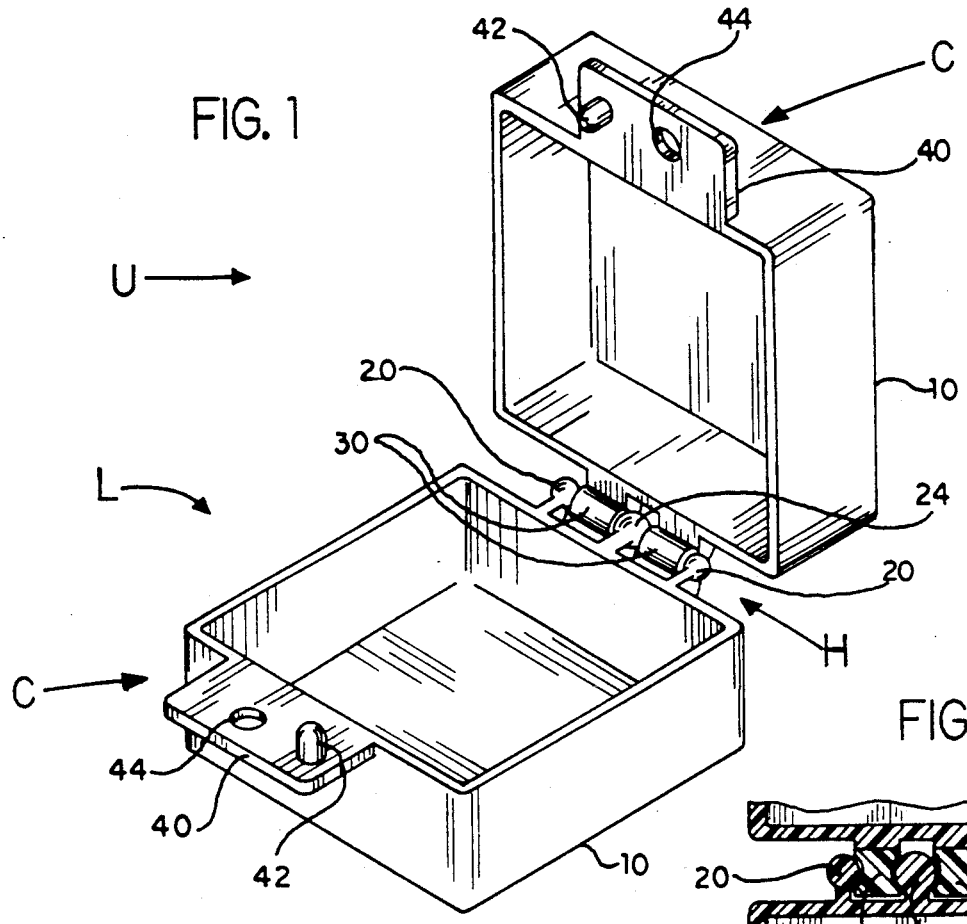
FIG. 1 is a perspective view of the box partially opened to show the interior. The hinges and closure are visible.
Figure 10:
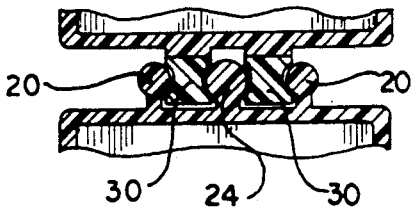
FIG. 10 is a cross-sectional view, taken along the line 10—10 of FIG. 2 and illustrates the configuration of the hinge components.
Figure 2:
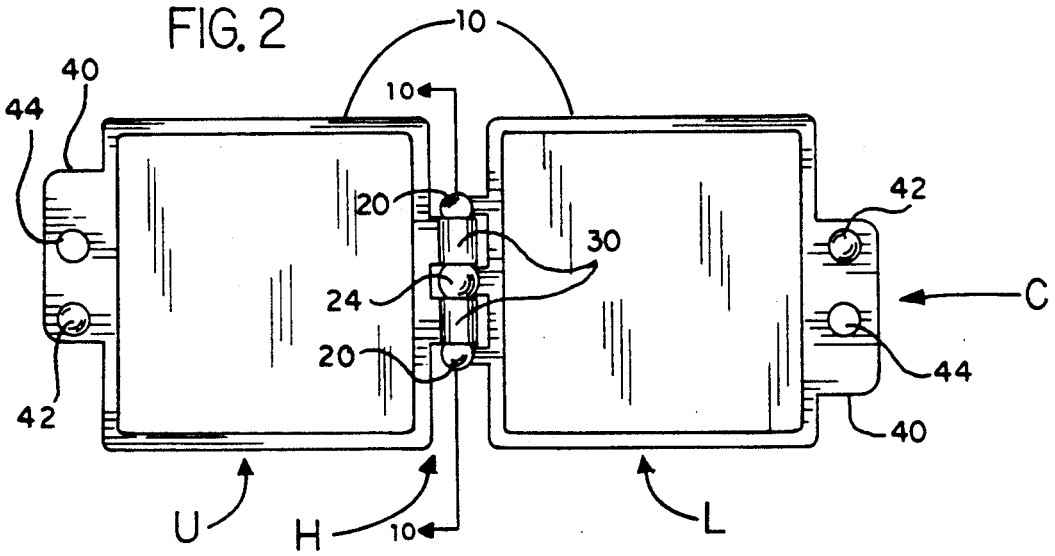
FIG. 2 is a plan view of the fully opened box, again showing the interior.

The present invention, a box, is shown in FIG. 1. It comprises two integral sections, an upper half U and a lower half L. Each half is molded as a complete unit, so that the box comprises just two moldings. The two halves L and U relatively rotate about a hinge H which is formed by snapping together parts of the two halves. The box halves are molded of elastic but stiff material, such as plastic, which will yield enough to allow snap action but is strong enough to maintain the shape of the box.

Each of the two halves includes an open rectangular container 10, a closure section C, and parts of the hinge H. Discounting the hinge parts, the upper half U and the lower half L are exactly the same. The hinge parts are different on the two halves, though.

(In this specification and in the following claims, the terms "upper" and "lower" applied to the halves of a box are merely for convenient description and differentiation of the halves, and have no strict relation to gravity. The box may of course be used in any position whatsoever in the gravity field of the earth.)

The hinge H works on the principle of a ball and socket, but the socket parts of the hinge H are more shallow (defining a smaller solid angle) than the typical socket. As best seen in FIG. 5, balls 20 and ball 24 fit snugly into concave sockets on the ends of cylindrical spacers 30. The two outer end balls 20 each define a sphere, which sphere also defines the concave shape of the outer ends of the spacers into which the outer balls fit. The central ball 24 defines a larger sphere, which is also defined by the two facing inner end surfaces of the spacers. These surfaces bound the medial gap between the spacers.

(The word "sphere" herein is used to denote a mathematical entity movable from place to place while retaining a particular radius, and "ball" is used to denote a physical object. Thus, herein and in the following claims, a single sphere may define a portion of one or more balls: each of the balls shares the radius and, at least in part, the shape of a single sphere.)

Thus, the hinge parts 20, 24, 30 are outlined by: a cylinder having an axis (which is also the hinge axis); a larger central sphere centered on the axis; and smaller spheres also centered on the axis, whose centers are equidistant from the center of the larger sphere. The physical surfaces of the two outer balls 20, the central ball 24, and the two spacers 30 are defined mostly by the above spheres and cylinder. In part, their physical surfaces do not coincide with the mathematical surfaces where they join the support arms 22, 26, and 32 which attach them to the containers 10. These support arms are best seen in FIGS. 3 and 4 and especially in FIG. 5. They include the central ball support arm 26, the outer ball support arms 22, and the spacer support arms 32.

The two molded parts U and L are joined by aligning the balls and spacers, and then forcing them together. The elastic material of the box will bend and the balls will snap into the sockets formed by the concave end surfaces of the two spacers. The balls and spacer ends are then in close rubbing contact. The touching spherical surfaces are of course able to move to any relative angle individually, but, since three ball and socket joints are aligned in a row, only motion about the axis of the spacers, which passes through the center of each sphere, is possible: hence a hinge is formed.

In the preferred embodiment, there is a single hinge as described above. The hinge may be multiplied as desired.

Typically, the box will enclose a rectangular box shape, and either half will include a rim defining a rectangle. The rim rectangles of the upper half U and lower half L are of course similar to mate and enclose the space inside the box. One leg of the rectangle will run parallel to the spacer axis. The rim will define a plane, in which that axis lies.

The closure C is formed on either container 10 by a plate 40. Each plate 40 is planar; the side of the plate 40 facing the other plate 40 when the box is closed will normally lie in the plane of the rim described above. The plate surfaces are thus coplanar and touching when the box is closed.

The two plates 40 are offset so that when the box is closed, there will be ledges on which one can exert mutually opposing forces to open the box. The box will be retained in the closed position, however, by the mating posts 42 and holes 44 of the plates 40.

Each post is of slightly smaller diameter than the mating hole 44, and also longer than the thickness of the plate 40, so that when the box is closed as shown in FIGS. 3 and 6, the post 42 will protrude through the hole 44. The base of the post 42, near to the plate 40, is concentric with the mating hole in the closed position.

The posts 42 may be slightly inclined to the plane of the rim to hold the plates together and keep the box shut. The inclination means that, as the plates start to separate, the sides of the holes 44 will contact and push against the posts 42. To actually open the box, the posts 42 will need to be elastically bent to one side. This means that the box will snap open. Conversely, it will snap shut. The posts 42 could also be made to interfere with the holes 44 in some equivalent way, such as by enlarging an end portion of the post.

An alternate embodiment of the present invention, a larger box, is shown in FIGS. 7–9. Only one box half is shown, because the one piece depicted functions as either the upper half U or the lower half L, depending on orientation: two of the pictured pieces mate to form one box.

For this to happen, certain symmetries must be present. The center line of the box, running vertically in the FIGS. 7 and 8, must be equidistant from the center of the central ball 24 and the center of the medial gap between the cylindrical spacers 30, and also equidistant from the centers of the hole 44 and post 42.

To reinforce the edges of such a larger box as shown, a raised bead 50 is molded into the corner of the container 10, as best shown in cross sectional FIG. 9 along section lines 9—9 of FIG. 7. The bead 50 not only stiffens the container 10 but also helps to prevent scratching of the large outer surface of the container 10 enclosed by the bead 50.

It is to be understood that the present invention is not limited to the sole embodiment described above, but encompasses any and all embodiments within the scope of the following claims.

I claim:

1. A box of stiff elastic material comprising a unitarily molded upper half and a unitarily molded lower half, the upper half and the lower half rotatably joined by at least one snap together hinge, each hinge comprising:

two coaxial cylindrical spacers sharing a spacer axis colinear with the axis of the hinge, each spacer joined to the upper half of the box by a spacer support arm, the spacers separated by a medial gap, each spacer including a concave inner end and a concave outer end, each spacer and respective spacer support arm integrally molded with the upper half of the box, the outer ends each defining a section of a first sphere centered on a respective point on the spacer axis exterior both to the spacers and to the medial gap, the first sphere having a smaller radius, the inner ends of the spacers facing the medial gap, the inner ends defining sections of a second sphere having a larger radius, the spacer axis passing through the center of the second sphere;

a central ball having the larger radius, joined to the lower half of the box by a central ball support arm, the central ball and the central ball support arm integrally molded with the lower half of the box, the spacer axis passing through the center of the central ball, the central ball disposed within the medial gap in rotatable contact with the inner ends; and a pair of outer balls having the smaller radius, each outer ball joined to the lower half of the box by a respective outer ball support arm, each outer ball and respective outer ball support arm integrally molded with the lower half of the box, the spacer axis passing through the centers of the outer balls, each outer ball in rotatable contact with an outer end of a respective spacer;

whereby, the three balls attached to the lower half of the box may rotate about the spacer axis while held against translation relative to the spacers attached to the upper half, so that the upper and lower halves may relatively rotate for opening and closing of the box about the hinge axis.

2. A box according to claim 1, including a closure, distal the hinge, comprising:

an upper plate extending from the upper half of the box, the axis of the hinge lying in the plane of a planar lower surface of the upper plate, the upper plate including an upper hole through the upper plate and an upper post extending downwardly from the upper plate;

a lower plate extending from the lower half of the box, the axis of the hinge lying in the plane of a planar upper surface of the lower plate, the lower plate including a lower hole through the lower plate for accepting therethrough the upper post upon closure of the box, and a lower post extending upwardly from the lower plate for inserting into the upper hole upon closure of the box, the upper plate and the lower plate equal in size, the upper plate offset from the lower plate in a direction parallel to the hinge axis to form overhangs for exerting finger forces upon the upper plate and the lower plate for opening the box, and the upper post having a diameter less than the diameter of the lower hole, the upper post positioned to pass through the lower hole when the box is closed, the upper post inclined from a normal to the plane of the lower surface of the upper plate, and the lower post having a diameter less than the diameter of the upper hole and positioned to pass through the upper hole when the box is closed, the lower post inclined from a normal to the plane of the upper surface of the lower plate, whereby when the box is opened, the posts will interfere with the holes and require opening force to pass the posts out of the holes, keeping the box closed unless the fingers forces are exerted upon the overhangs.

3. A box according to claim 2, wherein the upper half and the lower half join when the box is closed along respective mating rectangular rims, each of the rims having a hinge side adjacent and parallel to the spacer axis, and a closure side opposite the hinge side adjacent the closure.

* * * * *